United States Patent [19]

Frigo

[11] 4,135,473

[45] Jan. 23, 1979

[54] VEHICULAR SOUND GENERATOR

[75] Inventor: Domenico Frigo, Olmo (Vicenza), Italy

[73] Assignee: F.I.A.M.M. S.p.A. - Fabbrica Italiana Accumulatori Motocarri Montecchio, Montecchio Maggiore (Vicenza), Italy

[21] Appl. No.: 807,331

[22] Filed: Jun. 16, 1977

[30] Foreign Application Priority Data

Nov. 11, 1976 [IT] Italy ..... 29245 A/76

[51] Int. Cl.[2] ..... G10K 9/04; G10K 9/12; H04R 31/00

[52] U.S. Cl. ..... 116/142 R; 29/445; 29/594; 340/388; 340/404

[58] Field of Search ..... 116/142 FP, 142 FL, 116/142 R; 181/145, 152; 340/404, 388; 29/761, 169.5, 594; 179/114, 115

[56] References Cited

U.S. PATENT DOCUMENTS

| | | | |
|---|---|---|---|
| 1,351,729 | 9/1920 | Ames | 340/388 |
| 1,789,947 | 1/1931 | Scofield et al. | 340/388 |
| 1,797,120 | 3/1931 | Bennett | 340/388 |
| 1,841,535 | 1/1932 | Hueber et al. | 340/404 |
| 1,898,394 | 2/1933 | Riedel | 340/388 |
| 2,694,806 | 11/1954 | Johnson | 340/404 |
| 2,811,129 | 10/1957 | Buell | 116/124 R |
| 3,412,219 | 11/1968 | Karay | 29/594 X |
| 3,477,405 | 11/1969 | Jensen | 116/137 R |
| 3,967,367 | 7/1976 | Hayes et al. | 29/594 |

FOREIGN PATENT DOCUMENTS

| | | | |
|---|---|---|---|
| 2054252 | 5/1972 | Fed. Rep. of Germany | 340/388 |
| 1191512 | 10/1959 | France | 116/142 R |
| 1236553 | 6/1960 | France | 116/142 R |

*Primary Examiner*—Daniel M. Yasich
*Attorney, Agent, or Firm*—Karl F. Ross

[57] ABSTRACT

A vehicular warning device comprises a sound generator of electromagnetic or electropneumatic type with two components, one of them including a diaphragm, that are relatively axially movable in a generally cylindrical housing supporting both components. The peripheral housing wall has a corrugated zone forming at least one annular bulge which can be compressed between a pair of clamping jaws during tests following assembly. Such compression, with permanent deformation of the housing wall, reduces the axial height of the housing so as to narrow the air gap between a membrane-supported electromagnetic armature and a confronting core member or to intensify the pressure exerted by the diaphragm upon an entrance end of an air channel normally blocked by that membrane.

7 Claims, 6 Drawing Figures

VEHICULAR SOUND GENERATOR

FIELD OF THE INVENTION

My present invention relates to an acoustic warning device, e.g. for automotive vehicles, comprising an electromagnetic or electroacoustic sound generator of the type having a first and a second component disposed in a housing centered on an axis along which the two components are relatively movable, the first component including a diaphragm set in vibration by an electromagnetic field or by an air flow against an axial restraining force exerted upon that diaphragm by the housing.

BACKGROUND OF THE INVENTION

In my copending application Ser. No. 765,077, filed Feb. 3, 1977, I have described an electromagnetic sound generator with a generally cylindrical housing in which a disk-shaped membrane or diaphragm of ferromagnetic material, peripherally clamped between two housing parts, carries an armature of an electromagnetic coil confronting a stationary core member across an axial air gap. The stiffness of that diaphragm creates a restraining force which maintains the air gap in the de-energized state of the coil and limits the amplitude of the vibrations excited in response to an applied alternating field. Thus, the sound waves generated by the device are affected by the width of this air gap which, accordingly, should be properly calibrated.

In an electropneumatic sound generator, the diaphragm generally blocks an air channel in its quiescent state by contacting a tubular boss at an entrance end of that air channel from which it is intermittently lifted by an air flow entering the housing. Here, again, the resiliency of the diaphragm—which may be supplemented by the thrust of a pressure member supported on the housing—creates a restraining force which opposes the axial separation of the two components and thus determines the response to the sound generator to an actuation of the operating means, i.e. to the activation of a source of air pressure in this instance. A proper calibration of the contact pressure is particularly important where air from the same source is fed simultaneously and in parallel to two or more sound generators of this type to generate different musical notes; if the restraining force in one of these sound generators is significantly lower than in another, the latter will be largely bypassed by the air flow which follows the path of least resistance.

Even if a sound generator of either of the above-discussed types is properly adjusted at the time of assembly, the setting of its rather delicate parts may be disturbed during subsequent handling. Conventional readjusting means solve this problem only imperfectly.

OBJECT OF THE INVENTION

Thus, the object of my present invention is to provide an improved sound generator of electromagnetic or electropneumatic character which can be adjusted by simple means even after final assembly.

SUMMARY OF THE INVENTION

I realize this object, in accordance with my present invention, by providing the housing of the sound generator with a corrugated wall portion of flexible material forming one or more peripheral bulges which are permanently deformable by the temporary application of external pressure, as with the aid of a pair of annular clamping jaws, for axially foreshortening the housing to intensify the aforementioned restraining force.

In an electromagnetic sound generator of the kind described in my copending application Ser. No. 765,077, wherein the membrane or diaphragm is peripherally engaged by a part of the housing separated from another housing part supporting the coil and the core member, the corrugated wall portion can be disposed between these two housing parts.

In a sound generator of the pneumatic type, that wall portion may separate a housing part supporting the aforementioned pressure member from another housing part supporting the diaphragm and the tubular boss contacted thereby.

BRIEF DESCRIPTION OF THE DRAWING

The above and other features of my invention will now be described in detail with reference to the accompanying drawing in which.

SPECIFIC DESCRIPTION

Figure 1:
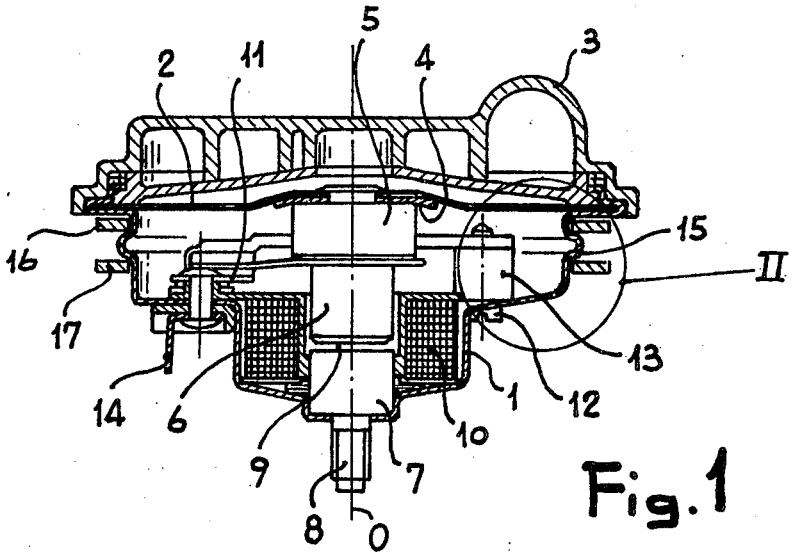
FIG. 1 is an axial sectional view of an electromagnetic sound generator according to my invention.
Figure 2:
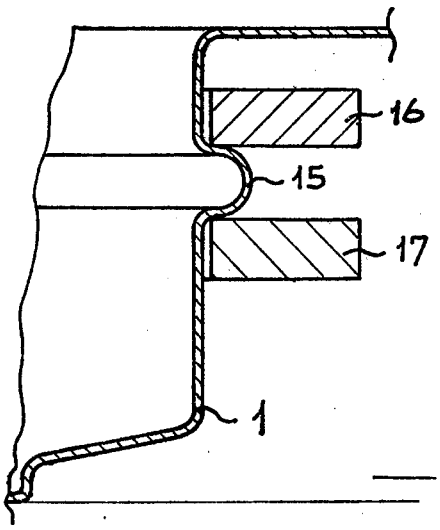
FIG. 2 is an enlarged view of a detail indicated at II in FIG. 1.
Figure 3:
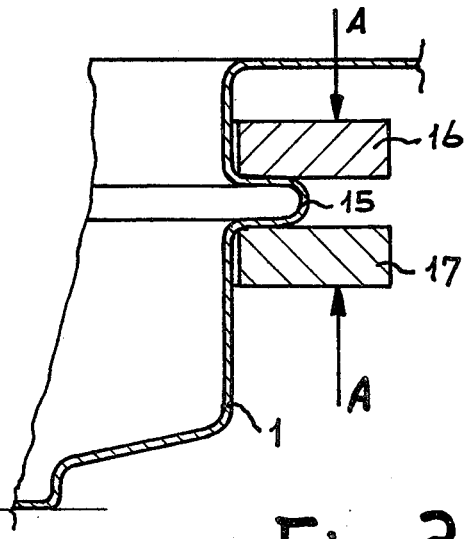
FIG. 3 is a detail view similar to FIG. 2 but showing a different position.

In FIGS. 1 to 3 I have shown an electromagnetic acoustic warning device provided with an outer case or housing 1, centered on an axis O, which is closed at the top by a diaphragm 2 of ferromagnetic material and has a resonant chamber 3 which is spirally wound in the embodiment shown but may alternatively be of rectilinear shape.

The diaphragm 2, peripherally clamped between the lower housing part and a lid forming the bottom of resonant chamber 3, is provided with a washer 4, also of ferromagnetic material, and is connected to ferromagnetic masses 5 and 6 to form therewith an oscillating component, mass 6 representing the moving armature of the device supported on base 5 and controlled by an electromagnetic coil 10.

A stationary core 7 is secured to the case 1 and terminates in an axially extending shaft 8 which enables the sound generator to be mounted on an automotive vehicle as an acoustic warning device. An air gap 9, illustrated in a quiescent state of the device is defined by the space between the confronting end faces of the moving armature 6 and the fixed core 7.

The width of air gap 9 is the result of a compromise since, during the oscillation of the diaphragm 2 and armature 6, the latter must never touch the core 7 even when the maximum supply voltage is applied to coil 10. However, in electromagnetic devices having a resonator disk, a percussion must take place between parts corresponding to elements 6 and 7 and must be accurately adjusted in order that the sound be regular, powerful and clear throughout the entire range of operating voltages. Furthermore, if this distance 9 is too large, the coil 10 is not able to attract the armature 6 when the warning device operates at low voltage.

An interrupter assembly 11, formed by movable and fixed contacts (only some of which are shown), serves to break the electric circuit of the coil every time the axially shiftable component 4, 5, 6 approaches, with its quiescent position toward the stationary component 7 and to re-establish the circuit each time the armature 6 moves away from the core 7 so as to produce the oscillation of the diaphragm 2.

Interrupter 11 is provided with an adjusting screw 12 and with a counteracting spring 13; a terminal pin 14 establishes the electrical connection of the coil 10 with its power supply. The sound generator so far described is similar to one disclosed in my copending application Ser. No. 765,077 referred to above.

The wall of case 1 is provided with a corrugated peripheral zone forming an annular bulge 15 which projects outwardly and is temporarily engageable by two annular jaws 16 and 17 (see FIG. 2) of a conventional clamping device.

Closure of the jaws 16 and 17 by the displacement thereof in the axial direction indicated by arrows A (see FIG. 3) causes a flattening or compression of the bulge 15 with consequent reduction of the distance of the bottom of the case 1 from its upper rim. Such foreshortening of the housing along its axis results in a reduction of the air gap 9.

The bulge 15 has a generally semicircular cross-section with a radius of curvature sufficiently reduced to translate even small movements of the jaws 16 and 17 into a plastic deformation of the wall of the case 1 with permanent flattening of the bulge 15. Any elastic return movements, which might occur when the jaws 16 and 17 are separated are constant and of only a minor extent so that it is readily possible take them into account during the adjustment of the air gap 9.

Calibration of the air gap 9 is effected by means of repeated partial compression of the bulge 15 interspersed with operating tests until the desired value of the air gap 9 is achieved, or by progressive flattening with simultaneous testing.

Figure 4:
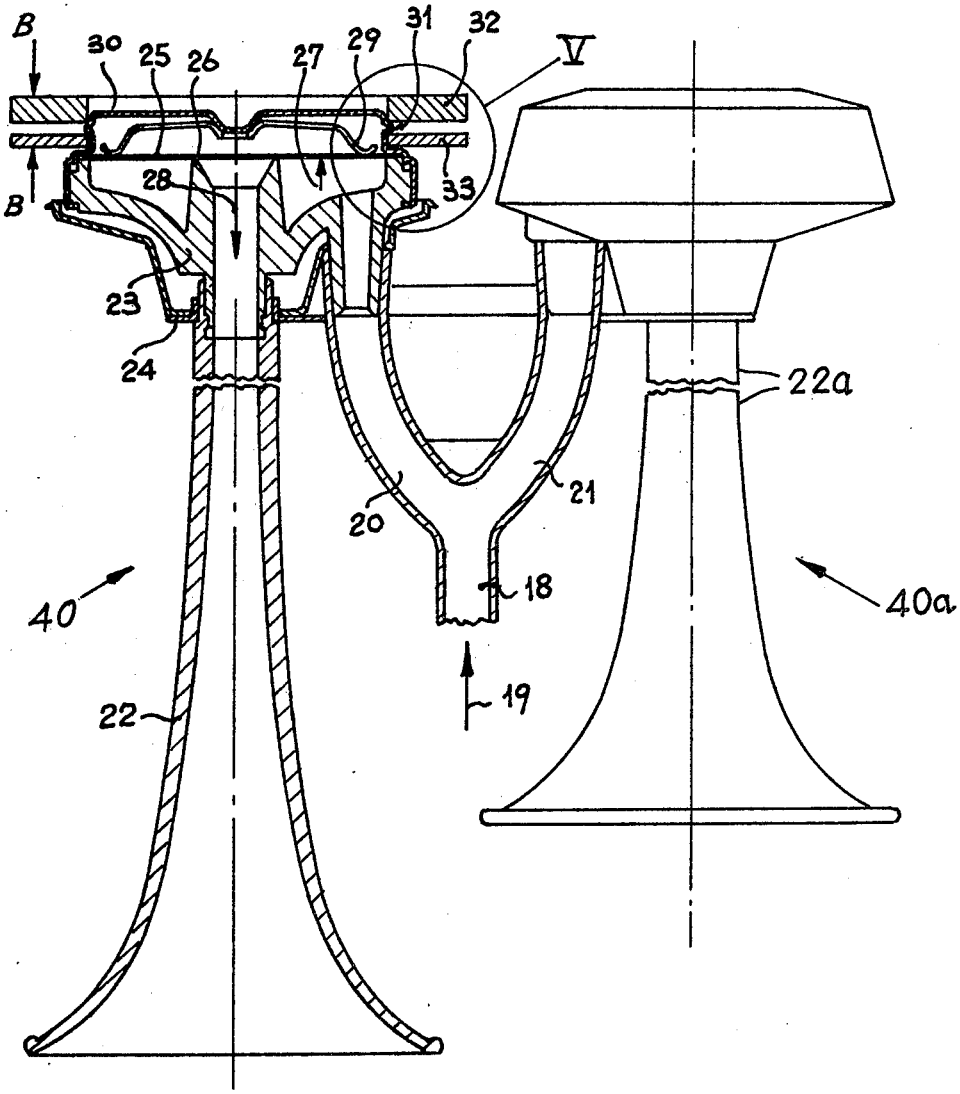
FIG. 4 is an illustration partly in section of an electropneumatic acoustic warning device including two sound generators according to the invention.
Figure 5:
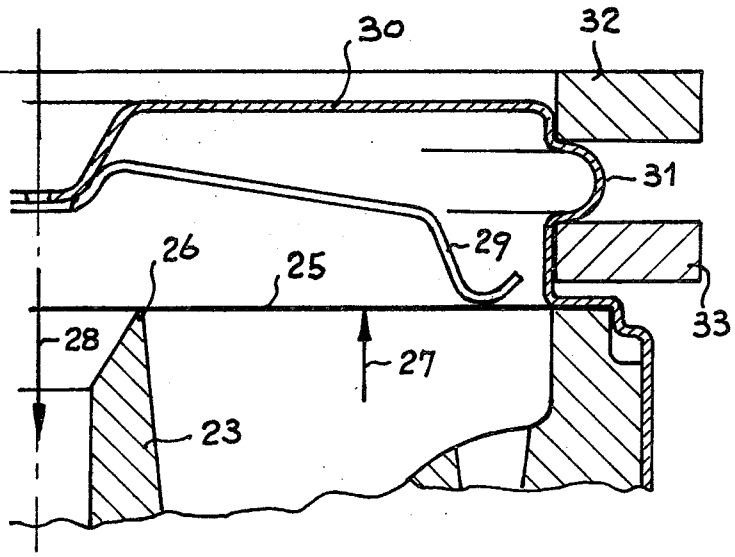
FIG. 5 is an enlarged view of the detail indicated at V in FIG. 4.
Figure 6:
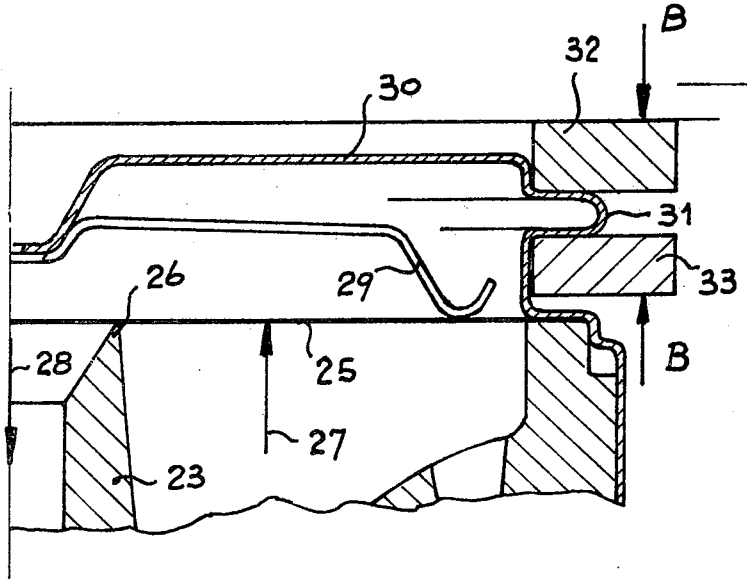
FIG. 6 is a detail view similar to FIG. 5 but showing a different position.

In FIGS. 4 to 6 I have shown an electropneumatic acoustic warning device having two sound generators **40, 40*a* fed by a pipe 18 with a flow of air indicated by an arrow 19 and generated by a conventional air compressor (not shown). The pipe 18 divides into two branches 20 and 21 for carrying air to the two sound generators 40, 40*a* which are respectively tuned to a low and a high note. Generators 40 and 40*a* have horns 22 and 22*a* of different length but are structurally identical otherwise; only generator 40** has been illustrated in detail.

The horn 22, in which the sound waves are formed, is coaxially connected with a cup-shaped member 23 and is engaged by a yoke 24 also secured to horn **22*a* for mounting both sections on a vehicle. A diaphragm 25 is supported on the rim of cup 23 and normally rests on a tubular boss 26 thereof forming an extension of horn 22. The passing of air through the pipe 20 exerts pressure on the diaphragm 25 in the direction of an arrow 27 until the diaphragm is deformed and becomes detached from the boss 26, letting the air flow in the direction of an arrow 28 through the boss 26 and the horn 22. The resulting pressure drop in pipe 20 reduces the thrust in the direction of the arrow 27 and lets the diaphragm 25 contact the boss 26** again.

If the air flow 19 is constant, the pressure necessary for raising the diaphragm 25 from the boss 26 of the cup 23 is proportional to the thrust that the diaphragm 25 exerts on that boss 26.

The thrust of the diaphragm 25 on the boss 26 is determined by a pressure member 29 located on a cover 30 of deformable material which complements the cup 23 into a housing surrounding the diaphragm. The peripheral wall of this cover 30 is provided with a corrugated zone 31 forming an outwardly projecting bulge engageable by two annular jaws 32 and 33 (see FIG. 5) of a conventional clamping device similar to the one of FIGS. 1–3. Closure of the jaws 32 and 33 by displacement thereof in the direction indicated by arrows B (see FIG. 6) effects a flattening or compression of the bulge 31 with consequent lowering of the top of the cover 30 relatively to housing bottom 23 and an increase in the thrust of the pressure member 29 on the diaphragm 25. The thrust of the member 29 is transmitted to diaphragm 25 which is thereby pressed more firmly against boss 26 so as to increase the pressure of air necessary for raising the diaphragm off that boss to generate a sound.

The calibration or setting of the operating pressure for each sound generator is effected by repeated partial compression of the bulge 31, or by progressive flattening, until a correct and uniform pressure is obtained in the two generators.

I claim:

1. In a vehicular warning device comprising a sound generator provided with a housing centered on an axis, a diaphragm transverse to said axis engaged by a peripheral zone of said housing with freedom of relative movement along said axis, an electromagnetic coil fixedly positioned in said housing and centered on said axis, a stationary core member in said housing extending axially into said coil from one end thereof, and a ferromagnetic armature carried on said diaphragm for vibrating same upon an energization of said coil with an intermittent current, said armature extending into said coil from the other end thereof and confronting said core member across an air gap, the improvement wherein said housing is provided between said pheripheral zone and said core member with a corrugated wall portion bent into a peripheral bulge which is selectively further deformable by the application of external pressure upon said bulge for axially foreshortening said housing to narrow said air gap for maintaining the width thereof within predetermined limits.

2. The improvement defined in claim 1 wherein said wall portion is substantially cylindrical on opposite sides of said bulge to facilitate a compression thereof between a pair of annular clamping jaws.

3. The improvement defined in claim 2 wherein said bulge has a generally semicircular cross-section.

4. In a vehicular warning device comprising at least one sound generator provided with a housing centered on an axis, a diaphragm transverse to said axis engaged by a peripheral zone of said housing with freedom of relative movement along said axis, a tubular boss centered on said axis and rigid with said housing at an entrance end of an air channel normally blocked by said diaphragm contacting said boss, biasing means secured to said housing and bearing upon said diaphragm for urging same toward said boss, and a source of air pressure trained upon said diaphragm for deflecting it from said boss against a restraining force exerted by said biasing means, the improvement wherein said housing is provided between said peripheral zone and said core member with a corrugated wall portion bent into a peripheral bulge which is selectively further deformable by the application of external pressure upon said bulge for axially foreshortening said housing to intensify said restraining force and for minimizing air leakage through said boss.

5. The improvement defined in claim 1 wherein said wall portion is substantially cylindrical on opposite sides of said bulge to facilitate a compression thereof between a pair of annular clamping jaws.

6. The improvement defined in claim 5 wherein said bulge has a generally semicircular cross-section.

7. The improvement defined in claim 4 wherein said warning device includes a plurality of structurally similar sound generators having housings connected in parallel to said source.

* * * * *